US007490442B1

(12) United States Patent
Jackson et al.

(10) Patent No.: US 7,490,442 B1
(45) Date of Patent: Feb. 17, 2009

(54) WINDOW SYSTEM FOR CONCRETE WALLS AND ASSOCIATED METHOD

(75) Inventors: James W. Jackson, Middletown, OH (US); Stephen Mayer, Huber Heights, OH (US)

(73) Assignee: Feather Lite Innovations, Inc., Springboro, OH (US)

( * ) Notice: Subject to any disclaimer, the term of this patent is extended or adjusted under 35 U.S.C. 154(b) by 866 days.

(21) Appl. No.: 10/899,744

(22) Filed: Jul. 27, 2004

(51) Int. Cl.
*E06B 1/02* (2006.01)

(52) U.S. Cl. ..... 52/215; 52/214

(58) Field of Classification Search ..... 52/214, 52/215; 249/35, 36, 39, 177, 184; 49/454, 49/466, 504
See application file for complete search history.

(56) References Cited

U.S. PATENT DOCUMENTS

| | | | | | |
|---|---|---|---|---|---|
| 2,787,820 | A | | 4/1957 | Shields et al. | |
| 2,840,203 | A | * | 6/1958 | Hehr | 52/214 |
| 2,893,235 | A | | 7/1959 | Goldberg | |
| 2,901,810 | A | | 9/1959 | Richards | |
| 3,517,906 | A | * | 6/1970 | Blonde | 249/39 |
| 3,769,769 | A | | 11/1973 | Kohl | |
| 3,995,843 | A | | 12/1976 | Kasteler | |
| 4,159,098 | A | * | 6/1979 | Wong | 249/39 |
| 4,430,831 | A | | 2/1984 | Kemp | |
| 4,589,624 | A | | 5/1986 | Jones | |
| 4,617,770 | A | * | 10/1986 | Hickman | 52/214 |
| 5,169,544 | A | * | 12/1992 | Stanfill et al. | 249/39 |
| 5,189,862 | A | * | 3/1993 | Lafleur | 52/204.593 |
| 5,319,884 | A | | 6/1994 | Bergeron | |
| 5,843,323 | A | * | 12/1998 | Ranard | 249/39 |
| 5,855,806 | A | * | 1/1999 | Caltrider | 249/39 |
| 6,185,884 | B1 | | 2/2001 | Myers et al. | |
| 6,550,194 | B2 | | 4/2003 | Jackson et al. | |
| 2007/0204535 | A1 | * | 9/2007 | Hughes | 52/215 |

FOREIGN PATENT DOCUMENTS

| | | |
|---|---|---|
| EP | 0127700 | 12/1984 |
| EP | 0568522 | 11/1993 |
| FR | 2551484 | 8/1985 |

OTHER PUBLICATIONS

OKNA Windows & Doors Manufacturer, www.oknawondiws.com, Website printout, dated pre-2004.
OKNA Windows & Doors Manufacturer, *OKNA Window Frame Photos*, dated pre-2004.

* cited by examiner

*Primary Examiner*—Richard E Chilcot, Jr.
*Assistant Examiner*—Matthew J Smith
(74) *Attorney, Agent, or Firm*—Wood, Herron & Evans, LLP

(57) ABSTRACT

A system and associated method for forming a window opening in a poured concrete wall and installing a window therein includes a one-piece reusable window buck having a number of retainers temporarily coupled thereto. An anchor portion of each retainer becomes embedded in the poured concrete wall and after the window buck is removed from the window opening formed in the wall, the window is easily and conveniently installed in the window opening and secured therein by the window retainer and cooperating clip on the window frame without the need for additional mechanical fasteners or tools.

32 Claims, 4 Drawing Sheets

WINDOW SYSTEM FOR CONCRETE WALLS AND ASSOCIATED METHOD

BACKGROUND OF THE INVENTION

This invention relates to poured concrete walls, and more particularly, to a window system and associated method for installing a window in a poured concrete wall.

In pouring walls of concrete such as residential basement walls, window openings are commonly formed in the concrete wall as it is being poured. In the past, it has been common to construct wood frames for window openings as a part of the wood wall forms for the concrete walls. After the poured concrete had set, the wood forms, including the wood window frames, were removed and at least the wood window frames had to be discarded. The cost of the wood window frames which are not reusable, and the labor required in building the frames were distinct disadvantages of this type of construction.

Another general method which has been used is a metal buck frame or surround which is positioned between the wall forms and cast in place in the concrete wall. When the wall forms are removed, the buck frame or surround is in place to form the periphery of the window opening. Unfortunately, these types of systems have been found to be subject to deformation during the pouring of the concrete. Additionally, cast in place buck frames or surrounds significantly increase the cost of a window installation because they are not reusable.

To avoid these disadvantages, various methods and systems have been proposed. For example, a reusable metal pouring window buck, which is positioned between the spaced wall forms, is one alternative. The bucks may be made in two parts and when the concrete which has been poured around the buck has set, the buck is removed from the window opening formed in the resulting concrete wall. Typically, a window frame is detachably secured within the buck such that the window frame is cast in and remains in the window opening when the concrete sets and the buck is removed. Unfortunately, due to the heavy forces delivered by the concrete being poured around the buck, this method has proven, in many instances, to be unreliable to protect the window contained within the buck. In many instances, the window is damaged or broken during the pouring of the concrete requiring additional time, effort and expense in repairing or replacing the window cast in place in the poured concrete wall. Furthermore, vinyl window frames, while providing many advantages acknowledged in the industry are highly susceptible to being damaged during the pouring of the concrete wall in such systems.

Alternatively, the window buck may be constructed of more robust materials to withstand the forces generated by the pouring and curing of the concrete and avoid deformation to the window buck and window. Examples of robust and reusable window buck systems are disclosed in U.S. Pat. Nos. 6,185,884 and 6,550,194, each assigned to the assignee of this invention and hereby incorporated by reference in its entirety. While the systems and methods shown in those patents have proven to be dramatic advancements over prior systems, improvements are still needed to minimize production costs and maximize ease of use of the window system for some applications.

A removable pouring buck allows a window to be installed into the window opening in the concrete wall after the buck has been removed. In the past, one disadvantage to such systems is the need for additional and often complicated or cumbersome fasteners to secure the window frame into the window opening. Typically, the window frame must be screwed, nailed, anchored or otherwise secured into the window opening with an additional fastener thereby requiring additional installation work, materials, tools and labor. Moreover, in many such systems, the window cannot be easily removed for cleaning, repair and/or replacement once installed in the window opening. Additionally, the initial installation is not easily accomplished and the window is not securely mounted in the window opening.

Therefore, there exists a need for an improved system and method for forming a window opening in a poured concrete wall and installing the window in that opening. The system and method should be economical, efficient and robust to withstand the forces of the poured concrete while allowing for the accurate and reliable positioning of the window in the poured concrete wall. Furthermore, the system and method must be applicable for a wide variety of window styles, sizes and materials while providing for easy and secure installation, removal and manipulation.

SUMMARY OF THE INVENTION

These and other objectives of the invention have been attained by a system and associated method for forming a window opening in a poured concrete wall and installing the window and associated frame into the opening. The components of the system include a reusable window buck which is adapted for placement between spaced wall forms to divert poured concrete around the window buck to form the window opening in the concrete wall. Advantageously, the window buck is reusable after being removed from the concrete wall.

According to presently preferred embodiments, the window buck is a one-piece component including a generally rectangular frame. The frame in one embodiment is generally rectangular and aluminum with an extension which forms a rim around the window opening in the concrete wall.

The frame is removable in only one direction from the poured concrete wall. The window buck advantageously forms a raised rim along a sill of the window opening proximate an interior side of the poured concrete wall to inhibit water from flowing through the window opening toward the interior side of the poured concrete wall. The raised rim is positioned against a flange projecting around the window frame. Moreover, the window buck forms a protruding rim along each jamb at each side of the window opening against which a flange of the window unit is positioned when installed in the window opening.

A component of the system according to a presently preferred embodiment of this invention is an improved retainer coupled to the window buck while the concrete is being poured so that the retainer is preferably partially embedded in the concrete wall proximate the window opening. The retainer preferably includes two frangible members which couple the retainer to the window buck so that upon removal of the window buck from the window opening the frangible members are broken leaving the remainder of the retainer embedded in the concrete wall. The frangible members in one embodiment are pins seated within holes in the window buck and retained there during installation of the buck between the wall forms and subsequent pouring of the concrete.

The retainer in a presently preferred form includes a socket which is exposed when the retainer is embedded in the concrete wall. Preferably, two such retainers are mounted to the bottom of the window buck and one retainer on each side of the buck. A window or window frame is easily snapped into the window opening and retained therein by spring clips or other devices mounted on the bottom and each side edge of the window frame or window. The spring clip temporarily deflects inwardly while the window or frame is being installed until the clip is seated within the socket of the embedded retainer. The configuration of the clip according to one aspect of this invention provides for secure installation in the window opening even if the retainer is not precisely aligned with the clip. Accordingly, the secure installation of the window or window frame is easily accomplished without tools or additional fasteners such as nails, screws or the like.

With the system and associated method according to this invention, a window opening is reliably formed in the desired location in a poured concrete wall without damaging a reusable, lightweight and robust window buck. Moreover, a window is securely, efficiently and conveniently installed in the window opening without the need for tools or additional fasteners in an easy, efficient and economical manner.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
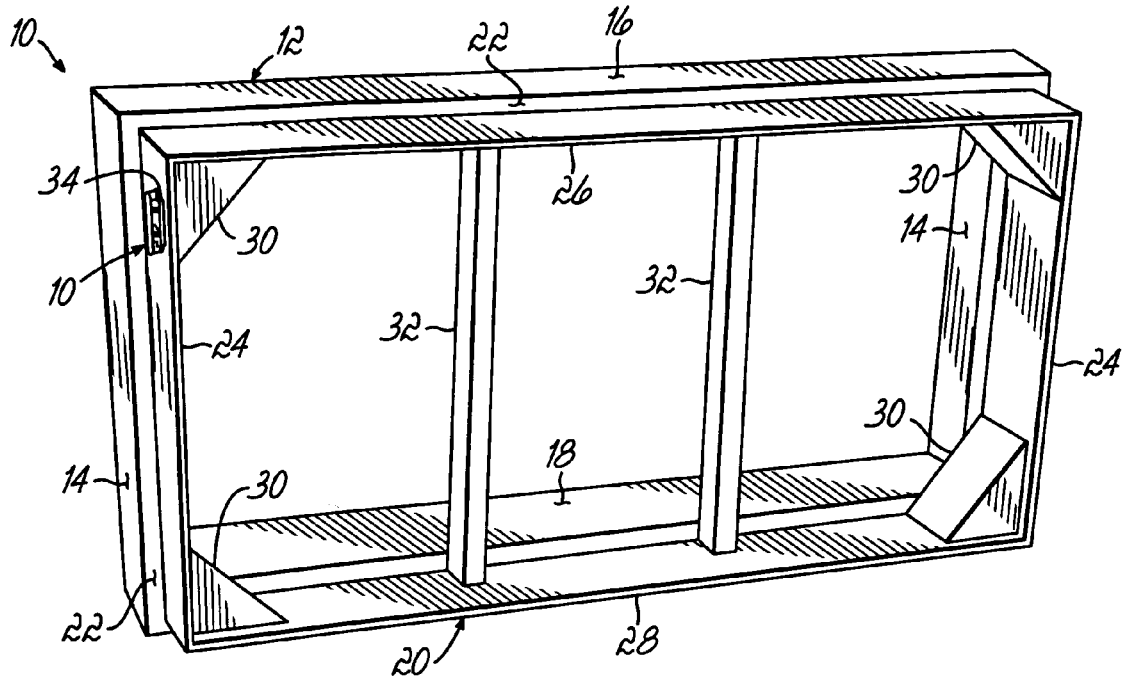
FIG. 1 is a perspective view of a first embodiment according to this invention of a window buck with a retainer coupled thereto.

A presently preferred embodiment of a window buck 10 according to this invention is shown in FIG. 1. The window buck 10 includes a generally rectangular and preferably aluminum frame 12 which includes a pair of spaced lateral sides 14, a top side 16 and a bottom side 18. The frame 12 includes a generally rectangular sub-frame extension 20 and a bulkhead 22 joining the frame 12 and extension 20 together. The extension 20 also has a pair of spaced lateral sides 24, a top side 26 and a bottom side 28. As shown in FIG. 1, the outer perimeter of the frame 12 is greater than the outer perimeter of the extension 20 and the difference is spanned by the bulkhead 22. The sub-frame extension 20 is generally rectangular with reinforcing triangular shaped webs 30 in each corner of the extension 20 for added support and rigidity. A pair of ribs 32 extend between top and bottom sides 26, 28 on the extension 20.

The buck 10 includes a number of holes 34 on the exterior face of each lateral side 24 and the bottom side 28. The holes 34 are sized and positioned so that a retainer 36 can be coupled to the window buck 10 prior to installation and use of the window buck 10.

The window buck 10 is adapted to be placed between spaced wall form panels and suspended therein as described in U.S. Pat. Nos. 6,185,884 and 6,550,194. Appropriate components may be added to the buck 10 to facilitate such an installation. Concrete is poured between the wall forms (not shown) and allowed to cure thereby forming a poured concrete wall 38. The window buck 10 diverts the poured concrete thereby forming a window opening 40 in the concrete wall 38, as shown particularly in FIG. 2. The faces of the sides 14, 16, 18, 24, 26, 28 are preferably sloped or tapered to assist in the removal of the buck 10 from the wall 38. The window opening 40 of FIG. 2 in the poured concrete wall 38 does not include a lintel. The window buck 10 of this invention may be used when a lintel (not shown) is to be formed along the top edge of the window opening 40, as is readily understood by one of ordinary skill in the art.

Figure 6:
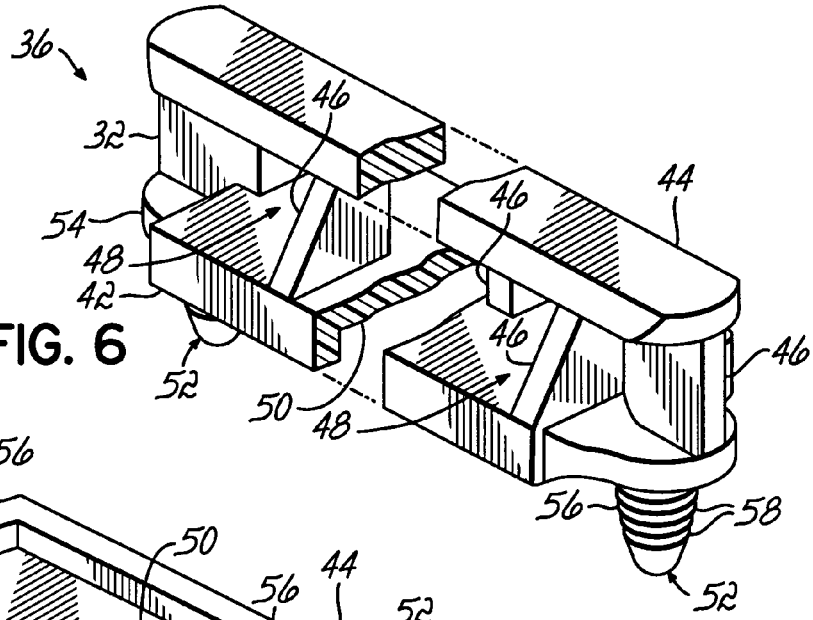
FIGS. 6 and 7 are each perspective views of the retainer adapted to be mounted to the window buck and embedded in the concrete wall according to one embodiment of this invention.
Figure 7:
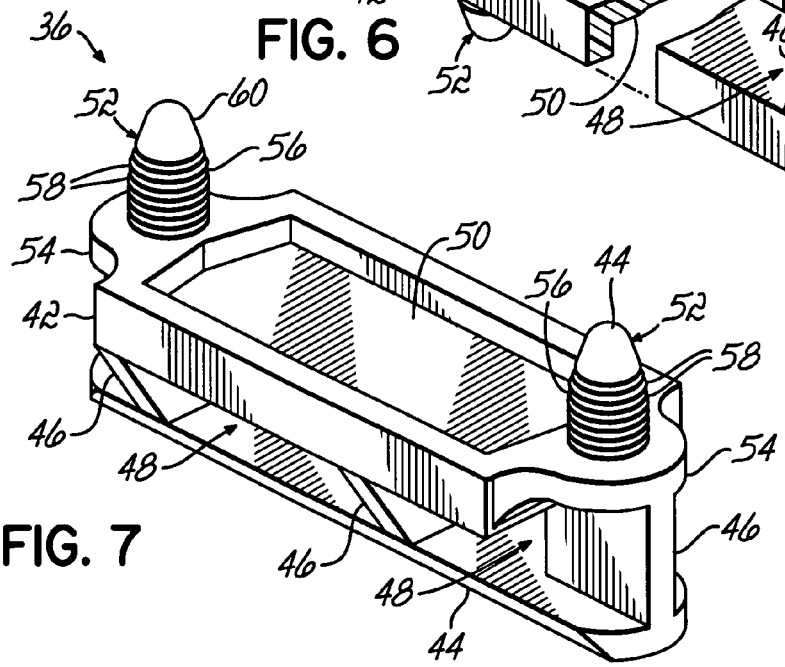

Referring to FIGS. 6 and 7, a presently preferred embodiment of the retainer 36 according to this invention is shown. The retainer 36 is secured to the holes 34 in the extension of the window buck 10. The retainer 36 is preferably molded from any one of a number of suitable plastics such as polyethylene or the like. The retainer 36 includes a retainer body 42 and an anchor 44 joined thereto in a spaced, generally parallel orientation. The anchor 44 is joined to the retainer body 42 by a number of spaced gussets 46. The spacings between the gussets 46, the anchor 44 and the retainer body 42 define passageways 48 in the retainer 36.

The retainer 36 includes a generally rectangular socket 50 formed in a face of the retainer body 42 opposite from the anchor 44. The retainer 36 also includes a pair of frangible members 52 projecting from tabs 54 on opposite ends of the retainer body 42 adjacent the socket 50 (FIG. 7).

Each frangible member is in the form of a pin 52 which is received within one of the holes 34 in the extension 20 of the buck 10. The pin 52 is oriented generally perpendicularly to the retainer body 42. The pin 52 includes a shaft 56 with a number of concentric ribs 58 which assist in secure placement of the retainer 36 in the holes 34 in the extension 20. The pin 52 also includes a conical-shaped distal tip 60.

The pins 52 are aligned with the holes 34 in the window buck 10 and can be then manually or otherwise inserted therein to securely couple the retainer 36 to the buck 10. The ribs 58 increase the frictional interaction between the pin 52 and the hole 34 for securely mounting the retainer 36 to the buck 10.

Figure 2:
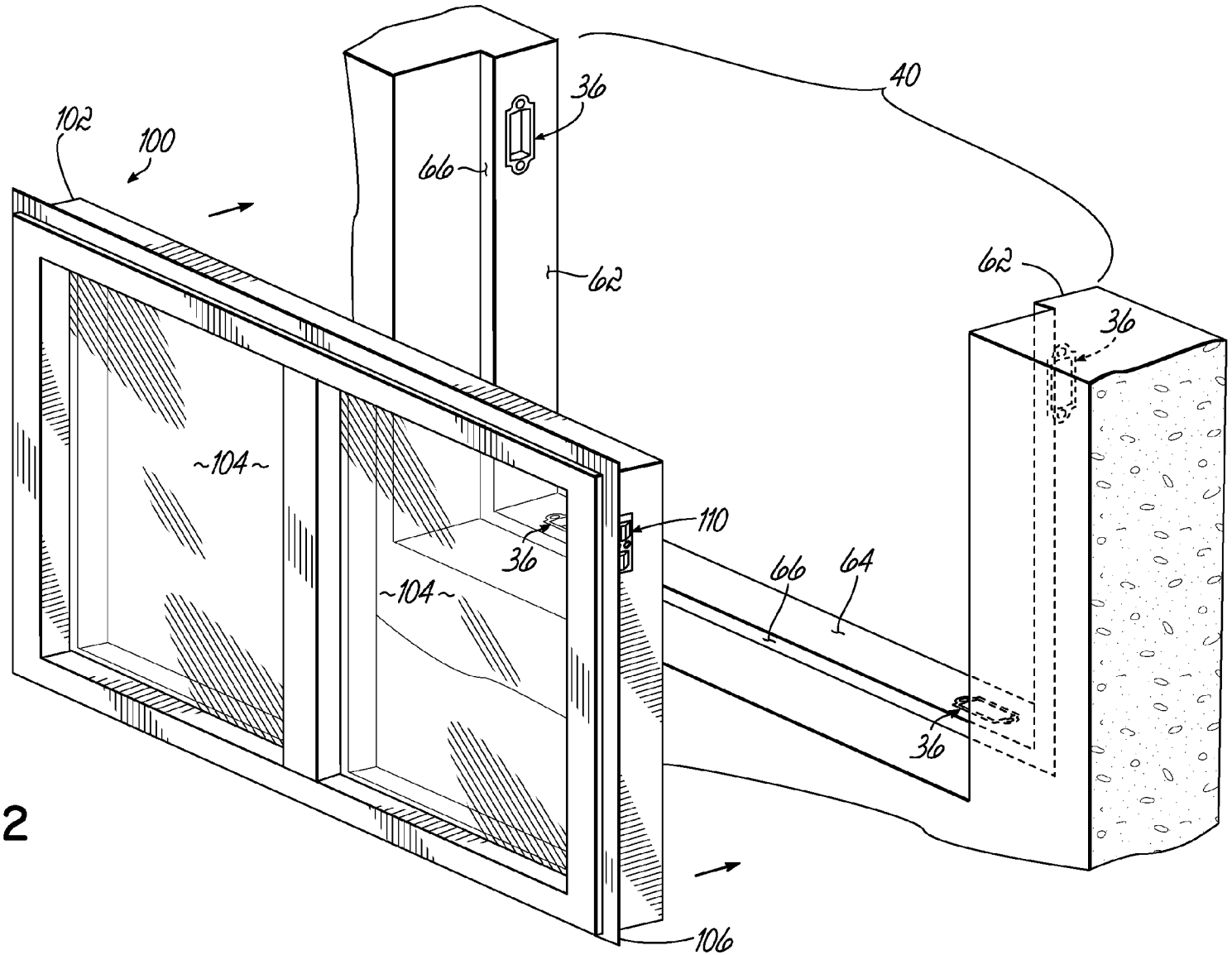
FIG. 2 is a perspective view of a window frame being installed into a window opening in a poured concrete wall formed by the window buck of FIG. 1.
Figure 3:
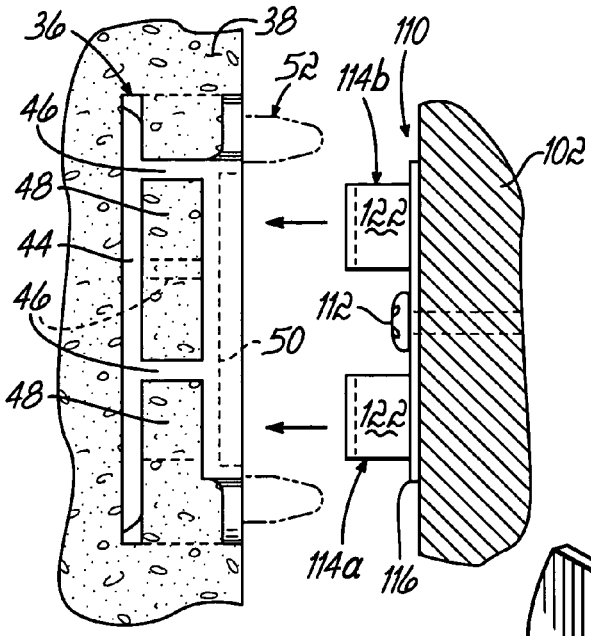
FIG. 3 is a cross-sectional view of a retainer embedded in the poured concrete wall and a clip on a window frame being installed therein.

After the concrete has been poured and allowed to cure and the wall forms removed from the poured concrete wall 38, the shaft 56 of each pin 52 is easily broken or severed from the buck 10 as the buck 10 is removed from the window opening 40. The anchor 44 and adjacent surfaces of the retainer 36 are embedded in the poured concrete wall 38 with the socket 50 and adjacent faces of the tabs 54 exposed along each jamb 62 and sill 64 of the window opening 40, as shown in FIG. 2. The configuration of the anchor 44 increases the holding power of the concrete to securely hold the retainer 36 because the concrete flows through the passageways 48 to surround the anchor 44 and gussets 46.

One presently preferred method of installing a window unit 100 in the poured concrete wall 38 according to this invention begins with erecting the pair of spaced wall forms. The retainers 36 are then coupled to the window buck 10 with the frangible pins 52 inserted into the corresponding holes 34 in the buck 10 as previously described. The retainers 36 and window buck 10 are then suspended between the spaced wall forms with any one of the known techniques, depending upon the desired position of the window opening 40 in the poured concrete wall 38. Concrete is then poured between the spaced wall forms and around the window buck 10 thereby partially embedding the retainers 36 in the poured concrete.

After the poured concrete is allowed to cure, the wall forms are dismantled and the retainers 36 are uncoupled from the window buck 10 by severing, breaking or otherwise fracturing the frangible pins 52 from the retainer 36. The window buck 10 is then pulled from the window opening 40 in the poured concrete wall 38. While a one-piece window buck 10 is shown and described, other designs are contemplated within this invention.

The bulkhead 22 between the frame 12 of the buck 10 and the extension 20 forms a rim 66 on the sill 64 of the window opening 40 and along the window opening jambs 62. The rim 66 at the sill 64 advantageously prevents the ingress of water or other moisture to the interior of the concrete wall 38 when the window unit 100 is seated on the sill 64 as shown in FIG. 2.

The window unit 100 to be installed in the window opening 40 according to a presently preferred embodiment of this invention has a generally tubular and rectangular frame 102 or other shaped configuration. The window unit 100 shown and described herein is but one of many window designs that can be utilized with this invention including glass block or other window designs and materials. The window unit 100 preferably includes the perimeter frame 102; although, other window constructions or types can be used, such as glass blocks or the like, that may not include a perimeter frame. The window unit 100 also includes one or more window elements 104, such as glass, screen or a glazing element. A generally planar flange 106 projects perpendicularly from the frame 102 and around the entire perimeter of the window unit 100. Preferably, the perimeter frame 102 of the window unit 100 includes an insulation or weather strip seal 108 extending on the flange 106 around the periphery of the window unit 100. A metal spring clip 110 or other type of preferably outwardly biased device or the like is mounted by a pair of bolts, screws or other fasteners 112 to each lateral and bottom side of the window frame 102 as shown in FIG. 2 for snap-fit engagement with the sockets 50 in the embedded retainers 36.

Figure 5:
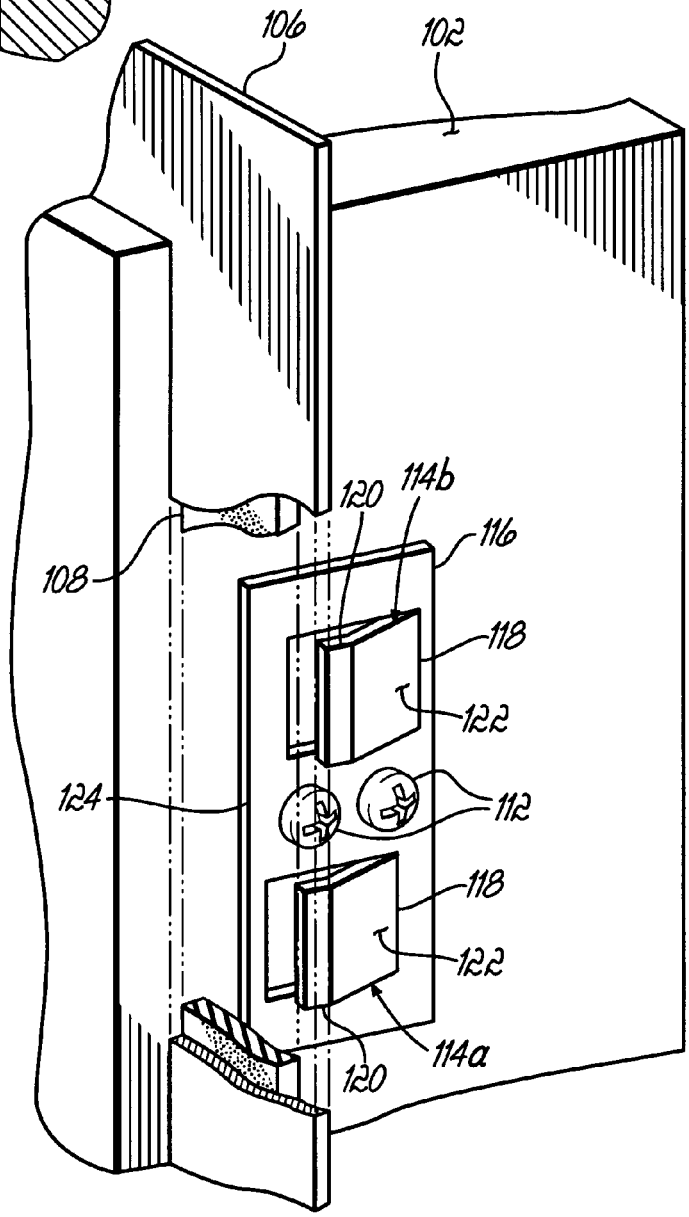
FIG. 5 is a perspective view, partially broken away, of a portion of the window frame and clip mounted thereon.
Figure 4:
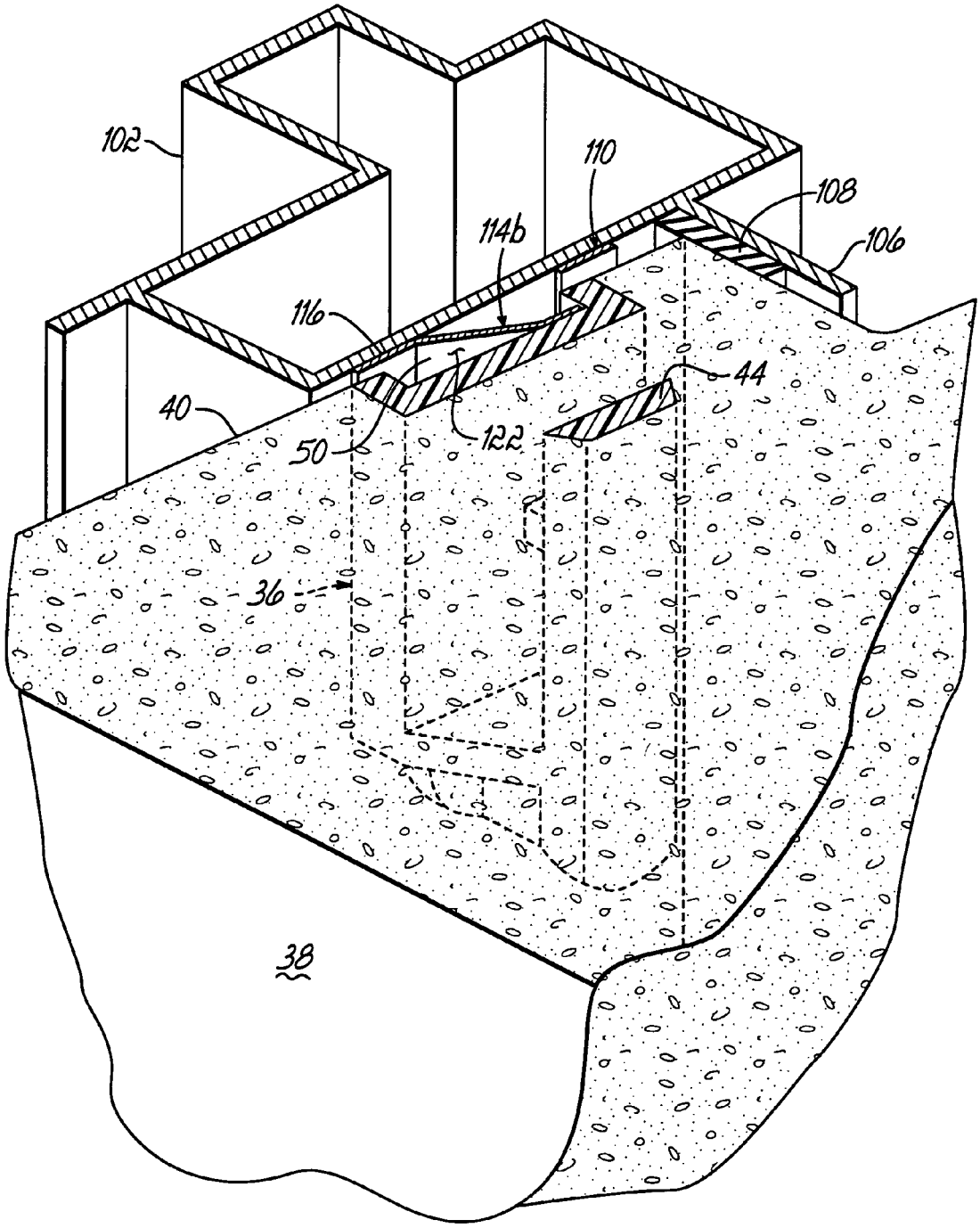
FIG. 4 is a perspective cross-sectional view of the window frame installed in the window opening in the concrete wall with the clip on the window frame engaged with the retainer embedded in the wall.

As seen most clearly in FIG. 5, each clip 110 according to one embodiment of this invention includes two spaced tangs 114 which project outwardly from a base 116 of the clip 110. Each tang 114 is preferably formed or punched from the material of the base 116 of the clip 110 and is deflected outwardly from a root 118 which joins the tang 114 to the base 116. In one embodiment, each tang 114 includes a distal end portion 120 which is oriented parallel to the base 116 and a sloped portion 122 joining the distal portion 120 to the root 118. Preferably, the tangs 114 are oriented as shown in FIG. 5 so that as the window unit 100 is pivoted into place in the window opening 40 in the concrete wall 38, the tangs 114 are deflected inwardly towards the base 116 as the clips 110 engage the retainers 36 embedded in the concrete. The tangs 114 will initially deflect inwardly towards the base 116 and then spring outwardly to be seated within the sockets 50 of the retainers 36 as shown in FIG. 4. One advantageous aspect of this invention is that the tangs 114 are deflected when the window unit 100 is installed in the window opening 40 so that the window unit 100 is urged by the deflected tangs 114 outwardly away from the portion of the window opening 40 adjacent the tangs 114. Since the window unit 100 includes clips 110 and associated retainers 36 on opposite jambs 62 of the window opening 40 and associated sides of the window frame 102, the deflected tangs 114 serve to center or position the window unit 100 laterally in the window opening 40. In one embodiment, the tangs 114 extend about 0.207 inches outwardly from the base 116 and the socket 50 is about 0.125 inches deep requiring the tangs 114 to deflect toward the base 116 when seated in the socket 50.

Another advantageous aspect of the window clip 110 according to this invention is that the tangs 114 of each clip 110 are staggered or offset relative to each other as shown in FIG. 5. Specifically, the lower tang 114*a* is positioned closer to an edge 124 of the clip 110 proximate the flange 106 than the upper tang 114*b* which is offset from the lower tang 114*a* and spaced further from the edge 124 of the clip 110. The offset or staggered relationship of the tangs 114 on the clip 110 allow for a more reliable and secure installation of the window unit 100 into the window opening 40 because the precise and accurate placement of the retainers 36 relative to the clips 110 is often difficult to obtain. The staggered relationship of the tangs 114 on the clips 110 allows for at least one of the tangs 114 to be securely seated within the socket 50 of the retainer 36 even if the retainer 36 is slightly offset from an aligned relationship with the clip 110. As shown in FIG. 2, the window unit 100 is installed into the window opening in a direction generally parallel with the stagger or offset of the tangs 114 on the window frame 102. While two offset tangs 114 are shown in the clip 110 of FIG. 5, it should be readily appreciated that more than two tangs 114 can be provided on the clip 110 and selected tangs 114 may be aligned with each other while the remaining tangs 114 of the clip 110 are offset relative thereto according to this invention.

The window installation according to this invention preferably includes four retainers 36 and associated clips 110 on the window frame 102: two of which are on the sill 64 and corresponding positions on the bottom of the frame 102 and two of which are on the jambs 62 and corresponding sides of the frame 102. Securing the window unit 100 along the sill 64 of the window opening 40 provides a more stable and secure installation of the window unit 100 compared to prior systems. It should be readily appreciated that while four attachment locations are shown in FIG. 2, additional attachment locations and corresponding clips/retainers may be included or located in alternate locations according to this invention.

While the spring clip 110 shown and described herein is a presently preferred embodiment, it should be understood that any of a variety of other devices, whether biased or not, are encompassed within this invention. The spring clip 110 or other device is advantageously mounted on the window unit 100 or window frame 102 prior to installation for easier and simpler installation without the need for additional mechanical fasteners or tools during installation.

The window unit 100 is installed from the exterior of the poured concrete wall 38 by seating a bottom edge of the window unit 100 or frame 102 along the sill 64 of the window opening 40 with the rim 66 juxtaposed to an interior face of the flange 106. The window unit 100 is then pivoted upwardly toward the jambs 62 of the window opening 40 until the flange 106 of the frame 102 seats against the rim 66 on the jambs 62 at the side edges of the window opening 40. The spring clips 110 temporarily deflect inwardly as the window unit 100 is pivoted upwardly and then spring out to extend into the sockets 50 of the retainers 36 and thereby secure the window unit 100 in the window opening 40. The window unit 100 can be selectively removed from the window opening 40 by inserting a hook-shaped tool or other device (not shown) between the window frame 102 and the jamb 62 to deflect the spring clip 110 on the window unit 100 inwardly and unseat it from the socket 50 and retainer 36 and then pivot the window 100 away from the window opening 40.

As a result, the window unit 100 is easily installed in an efficient manner without the need for additional tools or fasteners to secure the window unit 100 into the formed window opening 40 in the concrete wall 38. Moreover, the window buck 10 used in forming the window opening 40 can be cleaned and subsequently reused thereby minimizing the cost for the construction of the poured concrete wall 38 and window opening 40 therein.

From the above disclosure of the general principles of the present invention and the preceding detailed description of at least one preferred embodiment, those skilled in the art will readily comprehend the various modifications to which this invention is susceptible. For example, numerous other configurations and/or designs for the window buck, retainer and spring clip are possible within the scope of this invention. Therefore, we desire to be limited only by the scope of the following claims and equivalents thereof.

We claim:

1. A system for forming a window opening in a poured concrete wall, the window opening being adapted to retain a window therein, the poured concrete wall being formed from cured concrete previously poured between spaced wall forms, the system comprising:

a reusable generally rectangular window buck having four sides and being adapted for placement between the spaced wall forms to divert the poured concrete around the window buck to form the window opening in the concrete wall, the window buck being removable from the poured concrete wall for subsequent re-use after the wall forms are removed from the poured concrete wall; and a plurality of retainers coupled to at least three sides of the window buck while the concrete is being poured around the window buck, the retainers each being adapted to be at least partially embedded in the concrete wall proximate the window opening and adapted to be uncoupled from the window buck when the window buck is removed from the poured concrete wall, the retainers each being adapted to provide an attachment location for securing the window within the window opening.

2. The system of claim 1 wherein the retainers are coupled to opposed sides of the window buck and a bottom side of the window buck.

3. The system of claim 2 wherein two retainers are coupled to the bottom side and one retainer is coupled to each of the opposed sides of the window buck.

4. The system of claim 1 wherein each retainer includes a socket that is exposed when the retainer is embedded in the poured concrete wall, the socket being adapted to receive therein a device on the window to selectively retain the window in the window opening.

5. The system of claim 1 wherein the window buck further comprises:

a generally rectangular frame;

a generally rectangular extension projecting from the frame, wherein each side of the extension is shorter than the corresponding side of the frame; and a generally rectangular bulkhead interposed between and joining the frame and the extension.

6. The system of claim 5 wherein the sides of the frame and the corresponding sides of the extension are oriented generally parallel to each other and the sides of the bulkhead are generally perpendicular to the corresponding sides of the frame and extension.

7. The system of claim 5 wherein the frame, the extension and the bulkhead are adapted to form a rim around a perimeter of the window opening in the poured concrete wall.

8. The system of claim 1 wherein the window buck is adapted to form the window opening by being removed in a single direction relative to the poured concrete wall.

9. A system for installing a window in a window opening in a poured concrete wall, the poured concrete wall being formed from cured concrete previously poured between spaced wall forms, the system comprising:

a reusable generally rectangular window buck having four sides and being adapted for placement between the spaced wall forms to divert the poured concrete around the window buck to form the window opening in the concrete wall, the window buck being removable from the poured concrete wall for subsequent re-use after the wall forms are removed from the poured concrete wall;

a plurality of retainers coupled to at least three sides of the window buck while the concrete is being poured around the window buck, the retainers each being adapted to be at least partially embedded in the concrete wall proximate the window opening and adapted to be uncoupled from the window buck when the window buck is removed from the poured concrete wall;

a generally rectangular window unit adapted to be inserted into the window opening in the concrete wall; and a plurality of clips each adapted to engage one of the retainers embedded in the concrete wall proximate the window opening to secure the window unit within the window opening.

10. The system of claim 9 wherein the retainers are coupled to opposed sides of the window buck and a bottom side of the window buck and the clips are mounted to opposed sides of the window unit and a bottom side of the window unit.

11. The system of claim 10 wherein two retainers are coupled to the bottom side and one retainer is coupled to each of the opposed sides of the window buck and two clips are mounted to the bottom side of the window unit and one clip is mounted to each of the opposed sides of the window unit.

12. The system of claim 9 wherein each retainer includes a socket that is exposed when the retainer is embedded in the poured concrete wall, the socket being adapted to receive therein one of the clips on the window unit to selectively retain the window unit in the window opening.

13. The system of claim 9 wherein the window buck further comprises:

a generally rectangular frame;

a generally rectangular extension projecting from the frame, wherein each side of the extension is shorter than the corresponding side of the frame; and a generally rectangular bulkhead interposed between and joining the frame and the extension.

14. The system of claim 13 wherein the sides of the frame and the corresponding sides of the extension are oriented generally parallel to each other and the sides of the bulkhead are generally perpendicular to the corresponding sides of the frame and extension.

15. The system of claim 13 wherein the frame, the extension and the bulkhead are adapted to form a rim around a perimeter of the window opening in the poured concrete wall.

16. The system of claim 15 wherein the window unit further comprises:

a flange projecting from a perimeter of the window unit and adapted to be juxtaposed against the rim when the window unit is installed in the window opening.

17. The system of claim 9 wherein each clip further comprises:

a pair of tangs projecting outwardly from the window unit and adapted to engage one of the retainers embedded in the concrete wall.

18. The system of claim 17 wherein the pair of tangs of each clip are offset relative to each other.

19. The system of claim 18 wherein the tangs are offset relative to each other in a direction generally perpendicular to the plane of the concrete wall.

20. The system of claim 9 wherein each clip further comprises:

at least one tang projecting outwardly from the window unit and adapted to engage one of the retainers embedded in the concrete wall;

wherein the tangs are deflected inwardly when engaged with the corresponding retainer.

21. The system of claim 20 wherein the retainers are coupled to opposed sides of the window buck and the clips are mounted to opposed sides of the window unit to thereby center and position the window unit within the window opening.

22. A system for forming a window opening in a poured concrete wall, the window opening being adapted to retain a window therein, the poured concrete wall being formed from cured concrete previously poured between spaced wall forms, the system comprising:

a reusable generally rectangular window buck adapted for placement between the spaced wall forms to divert the poured concrete around the window buck to form the window opening in the concrete wall, the window buck being removable from the poured concrete wall for subsequent re-use after the wall forms are removed from the poured concrete wall; and a plurality of retainers coupled to the window buck while the concrete is being poured around the window buck, the retainers each being adapted to be at least partially embedded in the concrete wall proximate the window opening and adapted to be uncoupled from the window buck when the window buck is removed from the poured concrete wall, the retainers each being adapted to provide an attachment location for securing the window within the window opening;

wherein each retainer further comprises, (a) a retainer body;

(b) a socket formed in the retainer and which is exposed when the retainer is embedded in the poured concrete wall;

(c) an anchor oriented generally parallel to the retainer body and adapted to be embedded in the concrete;

(d) at least one gusset spanning between and joining together the retainer body and the anchor.

23. The system of claim 22 wherein each retainer further comprises:

at least one frangible element projecting from the retainer body to releasably couple the retainer to the window buck.

24. The system of claim 23 wherein the frangible element further comprises:

a pair of similarly oriented frangible pins projecting from the retainer body on opposite ends of the socket.

25. The system of claim 22 wherein the retainer body is spaced from the anchor to define a passageway there between through which the concrete may surround the anchor.

26. A window unit to be installed in a window opening formed in a wall, the window unit comprising:

a frame sized and configured to fit within the window opening in the wall;

a window element captured in the frame;

a plurality of clips mounted to the frame and adapted to engage the wall proximate the opening to thereby mount the frame in the window opening; and a pair of similarly oriented, spaced tangs each offset from one another on each of the clips and projecting outwardly therefrom to engage the wall;

wherein at least one of the tangs on each clip is offset from a remainder of the tangs on the clip in a direction generally perpendicular to the plane of the window element.

27. The window unit of claim 26 further comprising a pair of the clips on a bottom side of the frame and one of the clips one each lateral side of the frame.

28. The window unit of claim 26 further comprising:

a flange projecting outwardly from the frame and adapted to be juxtaposed to a rim bordering the window opening in the wall.

29. A method of installing a window in a poured concrete wall comprising the steps of:

temporarily coupling a plurality of retainers to a window buck, at least one of the retainers being coupled to a bottom side of the window buck;

pouring concrete around the window buck, the retainers being at least partially embedded within the poured concrete;

curing the poured concrete to form the poured concrete wall;

uncoupling the retainers at least partially embedded in the poured concrete wall from the window buck;

removing the window buck from the poured concrete wall to thereby expose a window opening in the poured concrete wall, a portion of each retainer being exposed in the poured concrete wall;

inserting a window unit in the window opening; and engaging each of a plurality of clips mounted on a periphery of the window unit with the exposed portion of one of the retainers to thereby secure the window in the window opening in the poured concrete wall.

30. The method of claim 29 wherein the uncoupling step further comprises:

fracturing a frangible portion of the retainer to thereby release a remainder of the retainer from the window buck.

31. The method of claim 30 wherein the fracturing step further comprises fracturing a terminal end portion of each of a pair of similarly oriented pins projecting from each retainer.

32. The method of claim 29 further comprising:

flowing concrete through a passageway in each retainer to thereby embed an anchor of each retainer in the concrete.

* * * * *